US007395739B1

(12) United States Patent
Chen

(10) Patent No.: US 7,395,739 B1
(45) Date of Patent: Jul. 8, 2008

(54) PORTABLE SCREWDRIVER

(76) Inventor: Jui-Tung Chen, No. 2, Ting-Chu-Wei, Huwei Chen, Yunlin Hsien (TW)

( * ) Notice: Subject to any disclaimer, the term of this patent is extended or adjusted under 35 U.S.C. 154(b) by 0 days.

(21) Appl. No.: 11/807,022

(22) Filed: May 25, 2007

(51) Int. Cl.
*B25B 23/16* (2006.01)
*B25B 23/00* (2006.01)

(52) U.S. Cl. ..... 81/177.4; 81/439; 81/490

(58) Field of Classification Search ..... 81/177.4, 81/437–439, 490
See application file for complete search history.

(56) References Cited

U.S. PATENT DOCUMENTS 5,265,504 A * 11/1993 Fruhm ..... 81/439
5,749,271 A * 5/1998 Liu ..... 81/438
6,305,815 B1 * 10/2001 Lin ..... 81/177.4
7,039,975 B1 * 5/2006 Liao ..... 81/177.4
7,305,908 B2 * 12/2007 Chi ..... 81/177.4
2002/0184979 A1 * 12/2002 Fruhm ..... 81/490
2007/0289418 A1 * 12/2007 Rodgers ..... 81/439

FOREIGN PATENT DOCUMENTS

EP 312775 A1 * 4/1989

* cited by examiner

*Primary Examiner*—D. S Meislin
(74) *Attorney, Agent, or Firm*—Charles E. Baxley

(57) ABSTRACT

A portable screwdriver has a tip cartridge movably mounted inside the portable screwdriver. The tip cartridge can protrude from and be stored in the portable screwdriver and has multiple clamps formed, which hold the tips that can be individually detached from the tip cartridge and mounted on the portable screwdriver. Thus, the portable screwdriver is compact and facilitates carrying. Moreover, the portable screwdriver stores the associated tips inside and effectively prevents the tips from being lost.

7 Claims, 7 Drawing Sheets

PORTABLE SCREWDRIVER

BACKGROUND OF THE INVENTION

1. Field of the Invention

The present invention relates to a screwdriver, and more particularly to a portable screwdriver that is compact, facilitates being carried and effectively prevents associated tips from being lost.

2. Description of Related Art

A conventional screwdriver has a shaft and a tip. The shaft has a front end. The tip is formed on the front end of the shaft and is configured to connect to a specific type of screw such as a slot, Phillip's head, torx head, etc.

To overcome the inconvenience of carrying many screwdrivers with various tips, screwdrivers with a body and interchangeable tips were developed. The tips are available in various sizes and shapes to accommodate different screws and are generally packed in a small toolbox to allow numerous tips to be carried with the body of the screwdriver.

Even though exchangeable tip screwdrivers overcame the necessity to carry many screwdrivers, losing individual tips or the entire tip toolbox is now a problem. Therefore, improvements still need to be made to exchangeable tip screwdrivers.

To overcome the shortcomings, the present invention provides a portable screwdriver to obviate or mitigate the aforementioned problems.

SUMMARY OF THE INVENTION

The main objective of the present invention is to provide a portable screwdriver that is compact and easily carried. Moreover, the portable screwdriver holds multiple associated tips inside and effectively prevents the tips from being lost.

To achieve the objective, the portable screwdriver in accordance with present invention comprises a tip cartridge movably mounted inside the portable screwdriver. The tip cartridge can be selectively mounted in or protrude from the portable screwdriver and has multiple clamps. The clamps are formed around the tip cartridge to hold the tips that can be individually removed from the tip cartridge and mounted on the portable screwdriver.

In such an arrangement, the portable screwdriver in accordance with present invention does not need a separate device like a toolbox to store tips. Consequently, the portably screwdriver is small and self-contained and is easy to carry, which is more convenient.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
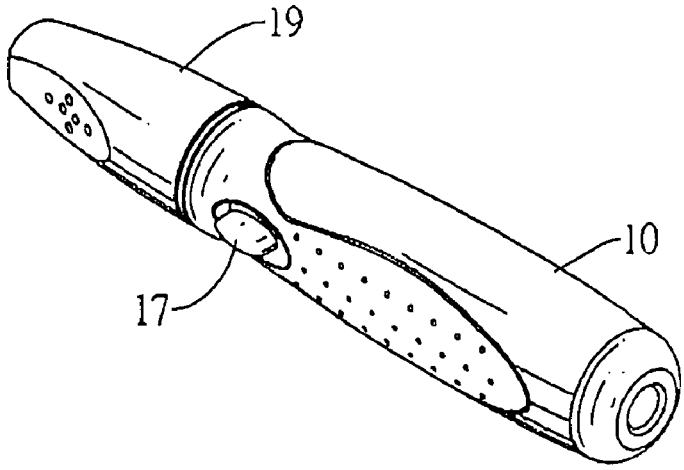
FIG. 1 is a perspective view of a portable screwdriver in accordance with the present invention.
Figure 2:
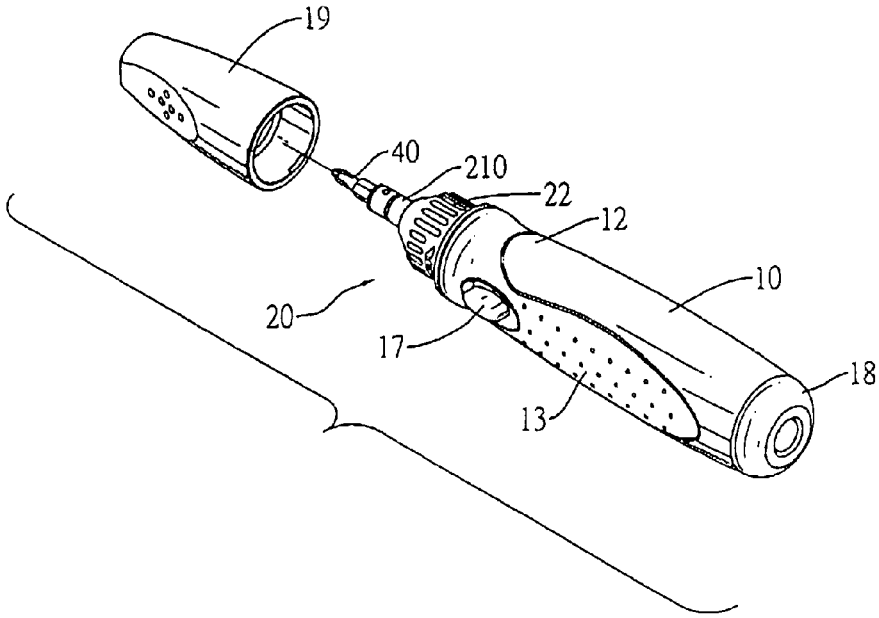
FIG. 2 is a partially exploded perspective view of the portable screwdriver in FIG. 1.
Figure 3:
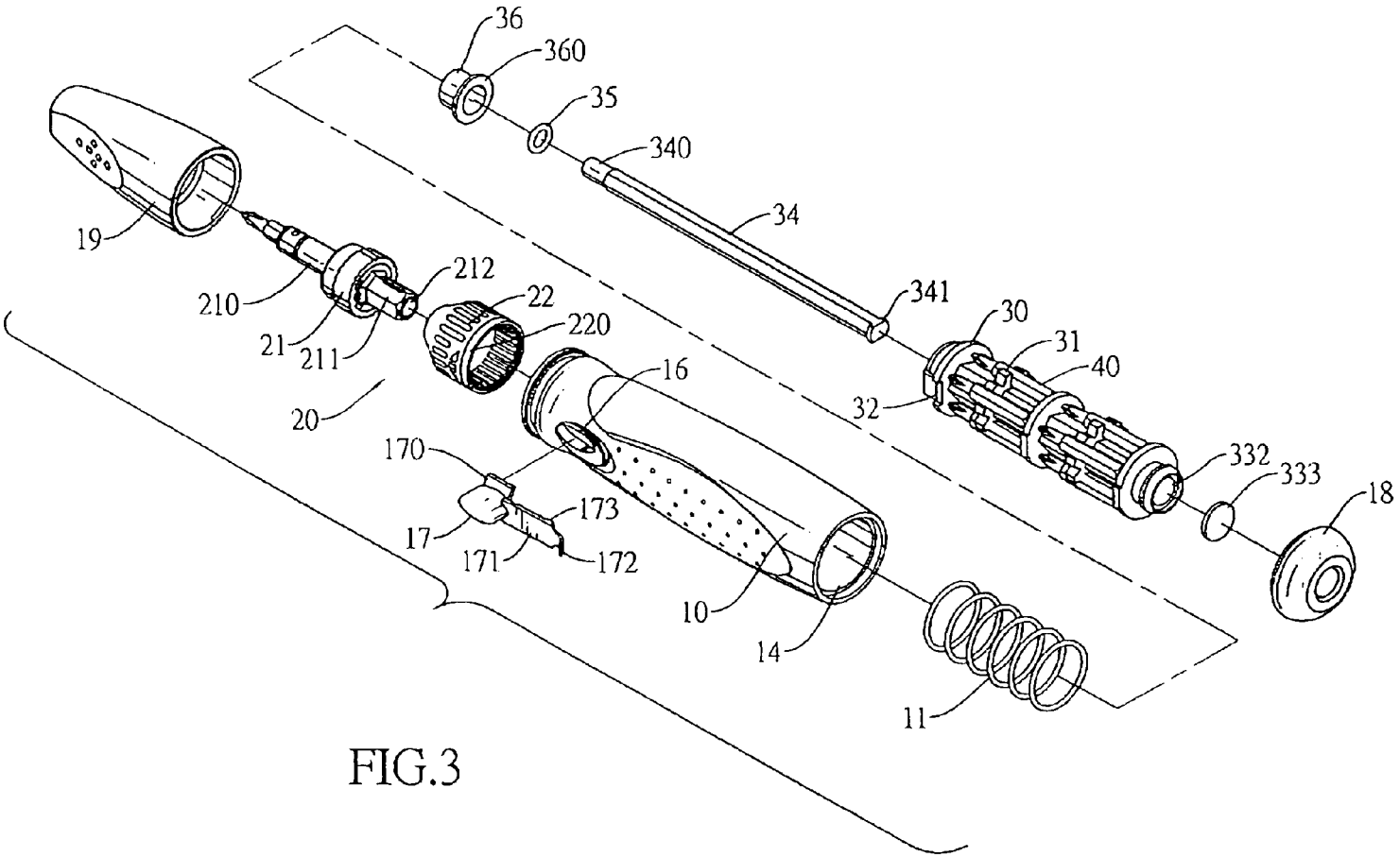
FIG. 3 is an exploded perspective view of the portable screwdriver in FIG. 1.
Figure 4:
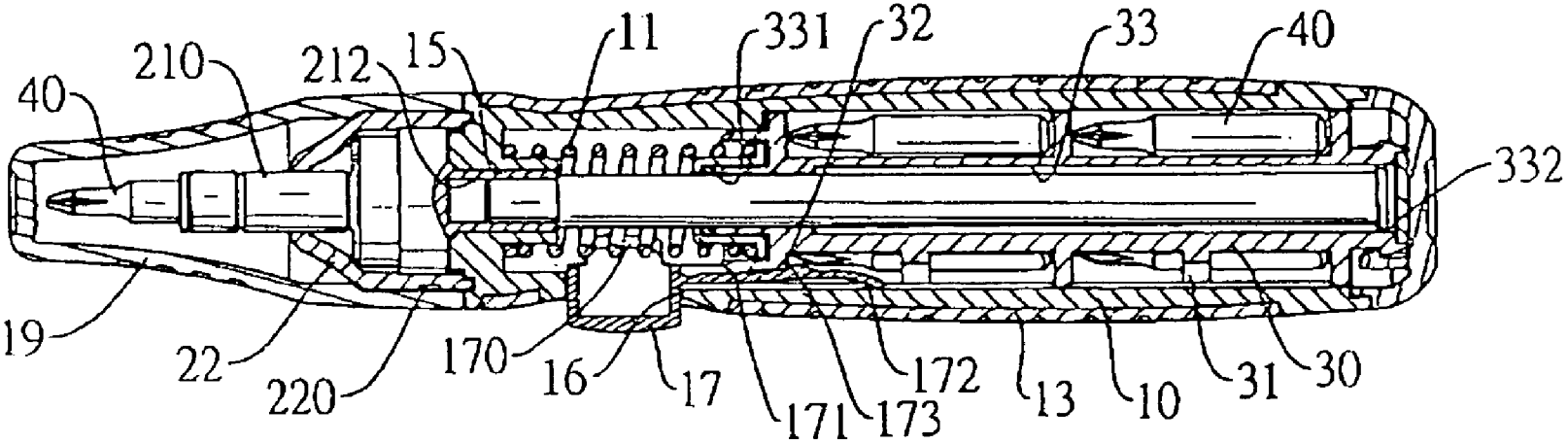
FIG. 4 is a cross sectional top view of the portable screwdriver in FIG. 1.

With reference to FIGS. 1, 2, 3 and 4, a portable screwdriver in accordance with the present invention comprises a body (10), a head (20), a tip cartridge (30) and multiple tips (40).

The body (10) is tubular and has an inner surface, an outer surface, a top, a front end, a rear end, an opening (14), a non-circular through hole (15), a thumb depression (12), a nonslip pad (13), a resilient element (11), a mounting hole (16), a button (17), an optional rear cap (18) and an optional front cap (19).

The front end has an inside surface.

The opening (14) is formed in the rear end.

The non-circular through hole (15) is formed axially through the front end of the body (10).

The thumb depression (12) is formed on the outer surface of the body (10) on the top and near the front end to allow a person to press the portable screwdriver forward.

The nonslip pad (13) is attached to the outer surface of the body (10) adjacent to the thumb depression (12) to enhance a person's grip on the portable screwdriver.

The resilient element (11) is mounted longitudinally in the body (10) against the inside surface of the front end coaxially around the non-circular through hole (15) and has a side surface and a front end and a rear end. The front end is mounted against the inside surface of the front end of the body (10).

The mounting hole (16) is formed through the body (10) near the front end of the body (10) adjacent to the thumb depression (12).

The button (17) is mounted movably in and protrudes from the mounting hole (16) in the body (10) and has an inner end, a flange (170) and a latching bar (171). The inner end is mounted inside the body (10). The flange (170) is formed on and protrudes out from the inner end, keeps the button (17) from being pressed out of the mounting hole (16), may be curved and abuts the side surface of the resilient element (11) to hold the button (17) resiliently in the mounting hole (16). The latching bar (171) is formed on and extends transversely from the inner end of the button (17) toward the rear end of the body (10) and has a middle, a distal end (172) and a latch (173). The distal end (172) is resilient, curves out and presses against the inner surface of the body (10). The latch (173) is formed on the latching bar (171) near the curved end (172) and protrudes inward relative to the body (10).

The rear cap (18) is mounted detachably on the rear end of the body (10) to close the opening (14).

The front cap (19) has a rear end and a lip. The lip is formed in and protrudes slightly in from the front cap (19) at the rear end of the front cap (19).

The head (20) is mounted coaxially on and protrudes longitudinally from the front end of the body (10) and has a tip socket assembly (21) and a mounting sleeve (22).

The tip socket assembly (21) is mounted coaxially in and protrudes longitudinally from the front end of the body (10) and has a proximal end, a distal end, a mounting rod (211) and a tip socket (210). The mounting rod (211) is formed on and protrudes longitudinally from the proximal end of the tip socket assembly (21), corresponds to and is mounted in the non-circular through hole (15) in the front end of the body (10) and has a distal end and a mounting hole (212). The mounting hole (212) is formed coaxially in the distal end of the mounting rod (211). The tip socket (210) is formed coaxially on and protrudes longitudinally from the distal end of the tip socket assembly (21).

The mounting sleeve (22) is attached securely to the front end of the body (10) and may have an annular groove (220) to hold the lip in the front cap (19).

The tip cartridge (30) is mounted movably in the body (10), selectively extends from the opening (14) in the body (10) and comprises a front end, a rear end, multiple clamps (31), a latch lip (32), a central chamber (33), a cover (333), a central post (34), a mounting bracket (36) and an optional gasket (35).

The front end of the tip cartridge (30) abuts the middle of the latching bar (171) to make the latching bar (171) slightly pivots relative to the tip cartridge (30) when the button (17) is pressed.

The clamps (31) are formed around the tip cartridge (30) and are resilient, and each clamp (31) has a pair of protrusions.

The latch lip (32) is formed on the tip cartridge (30) near the front end to allow the latching bar (171) to pass between the latch lip (32) and the inner surface of the body (10) and engages the latch (173) on the latching bar (171) to hold the tip cartridge (30) inside the body (10) when the distal end (172) of the latching bar (171) abuts the inner surface of the body (10).

The central chamber (33) is defined longitudinally inside the tip cartridge (30), may have hydraulic fluid inside to damp the movement of the tip cartridge (30) and has a front opening (331) and a rear opening (332). The front opening (331) is formed in the front end of the tip cartridge (30). The rear opening (332) is formed in the rear end of the tip cartridge (30).

The cover (333) is detachably attached to the rear opening (332) of the tip cartridge (30).

The central post (34) is mounted slidably coaxially through the central chamber (33) and the resilient element (11) to restrict the tip cartridge (30) to longitudinal movement and has a front end (340) and a rear end (341). The front end (340) protrudes from the front opening (331) in the central chamber (33) and is mounted securely in the mounting hole (212) in the mounting rod (211) of the tip socket assembly (21). The rear end (341) has two lips. The lips are formed on and protrude transversely from the rear end (341) opposite to each other and selectively abut the inner surface around the non-circular through hole (15) in the body (10) to keep the tip cartridge (30) from disengaging from the central post (34).

The mounting bracket (36) is mounted securely on the front end of the tip cartridge (30) in the rear end of the resilient element (11) and around the central post (34) and has a rear edge, a central hole and a flange (360). The central hole corresponds to and aligns with the front opening in the tip cartridge (30) and is mounted around the central post (34). The flange (360) is formed on and protrudes radially out from the rear edge of the mounting bracket (36) and abuts the rear end of the resilient element (11).

The gasket (35) may be resilient and is mounted around the central post (34) between the mounting bracket (36) and the front end of the tip cartridge (30) to seal the front opening of the tip cartridge (30).

Figure 5:
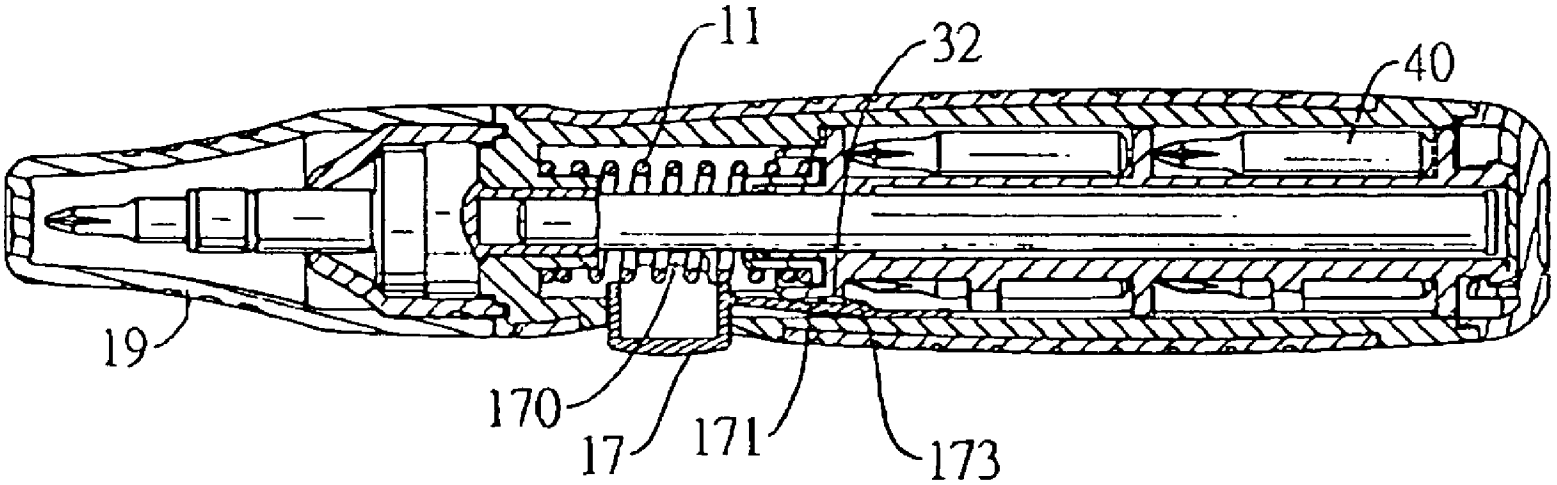
FIG. 5 is a cross sectional top view of the portable screwdriver in FIG. 1.
Figure 6:
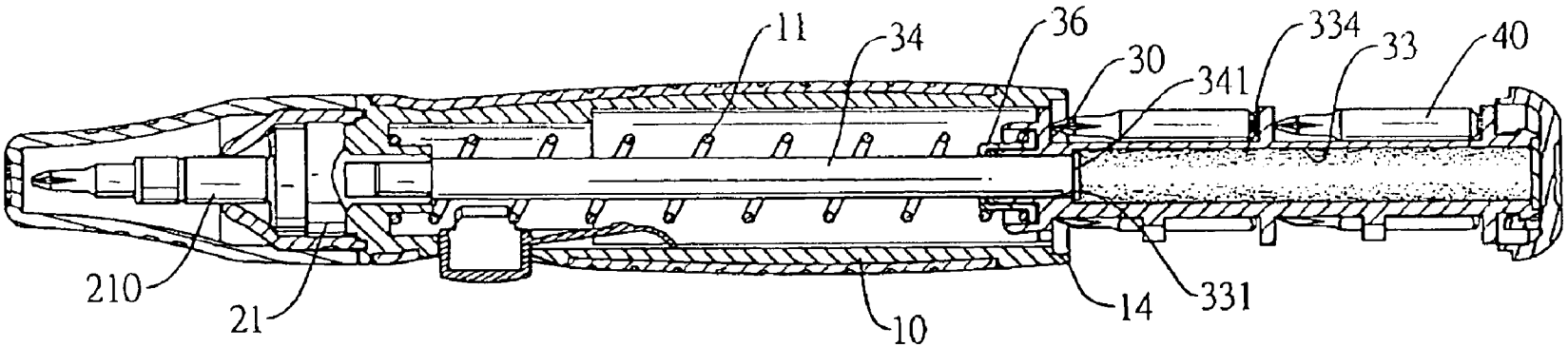
FIG. 6 is an operational cross sectional top view of the portable screwdriver in FIG. 1.
Figure 7:
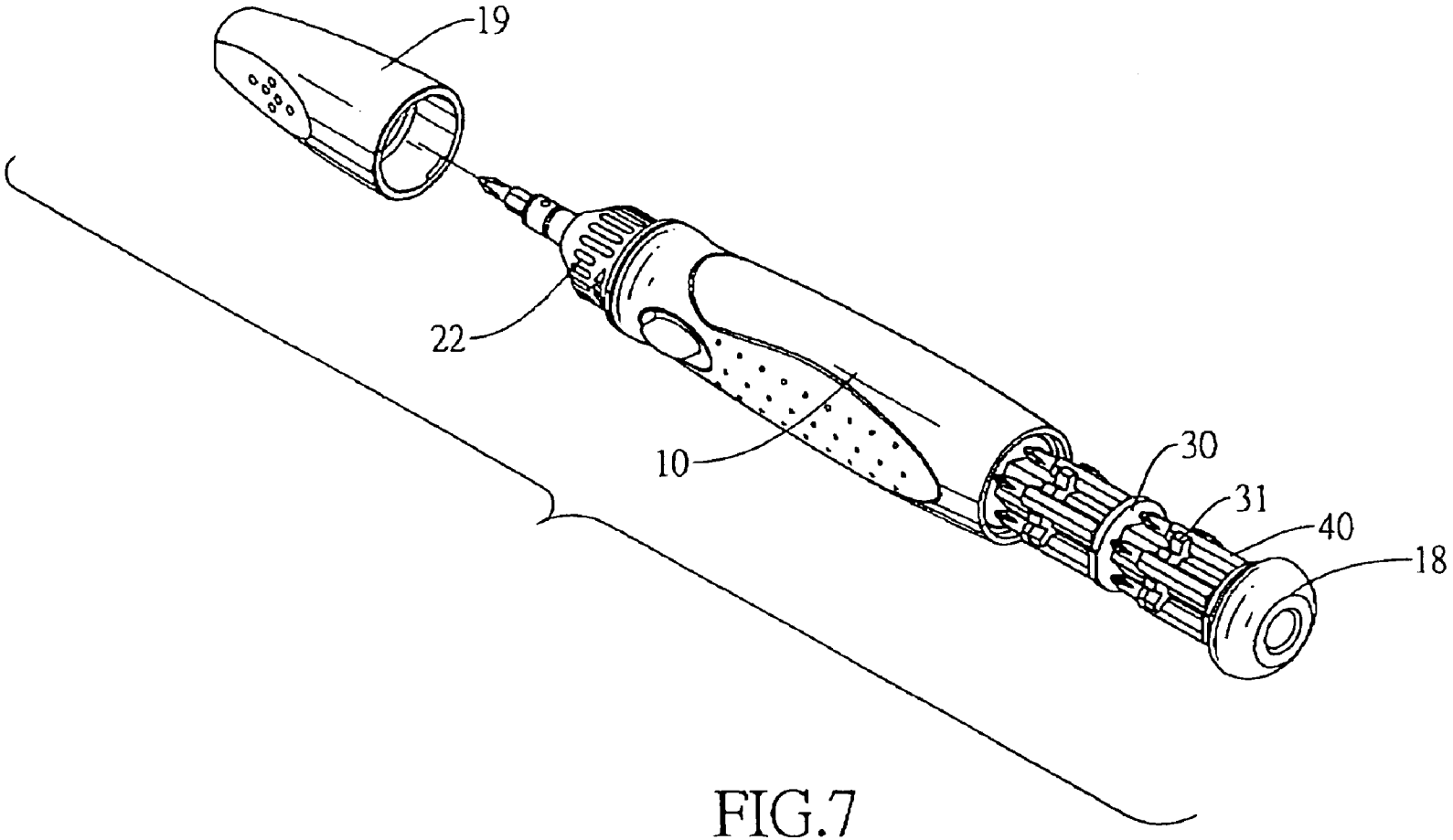
FIG. 7 is an operational perspective view of the portable screwdriver in FIG. 1.

With further reference to FIGS. 4, 5, 6 and 7, the tips (40) are stored in the clamps (31) of the tip cartridge (30), and one tip (40) may be mounted in the tip socket (210) when the portable screwdriver is to be used. To remove a tip (40) from the tip cartridge (30), the button (17) is pressed to disengage the latch (173) of the latching bar (171) from the latch lip (32) on the tip cartridge (30). Then, the resilient element (11) will push the tip cartridge (30) out of the opening (14) in the body (10). A desired bit (40) is removed from the clamp (31) and mounted in the tip socket (210). To store the tip cartridge (30), the tip cartridge (30) is pressed into the opening (14) of the body (10) until the latch lip (32) of the tip cartridge (30) engages the latch (173) of the latching bar (171) of the button (17).

Accordingly, the portable screwdriver as described is compact and facilitates carrying and effectively prevents the tips (40) from being lost.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. A portable screwdriver comprising a body being tubular and having
- an inner surface;
- an outer surface;
- a top;
- a front end having an inside surface;
- a rear end;
- an opening being formed in the rear end;
- a non-circular through hole being formed axially though the front end of the body;
- a resilient element being mounted longitudinally in the body against the inside surface of the front end coaxially around the non-circular through hole and having
  - a side surface;
  - a front end being mounted against the inside surface of the front end of the body; and
  - a rear end;
- a mounting hole being formed through the body near the front end of the body adjacent to a thumb depression; and
- a button being mounted movably in and protruding from the mounting hole in the body and having
  - an inner end being mounted inside the body and abutting the side surface of the resilient element; and
  - a latching bar being formed on and extending transversely from the inner end of the button toward the rear end of the body and having
    - a middle;
    - a distal end being resilient, curving out and pressing against the inner surface of the body; and
    - a latch being formed on the latching bar near the curved end and protruding inward relative to the body;

a head being mounted coaxially on and protruding longitudinally from the front end of the body and having
- a tip socket assembly being mounted coaxially in and protruding longitudinally from the front end of the body and having
  - a proximal end;
  - a distal end;
  - a mounting rod being formed on and protruding longitudinally from the proximal end of the tip socket assembly, corresponding to and being mounted in the non-circular through hole in the front end of the body and has
    - a distal end; and
    - a mounting hole being formed coaxially in the distal end of the mounting rod; and a tip socket being formed coaxially on and protruding longitudinally from the distal end of the tip socket assembly; and a mounting sleeve being attached securely to the front end of the body; and a tip cartridge being mounted movably in the body, selectively extending from the opening in the body and comprising a front end abutting the middle of the latching bar;

a rear end;

multiple clamps being formed around the tip cartridge and being resilient, and each clamp having a pair of protrusions;

a latch lip being formed on the tip cartridge near the front end to allow the latching bar to pass between the latch lip and the inner surface of the body and engaging the latch on the latching bar;

a central chamber being defined longitudinally inside the tip cartridge and having a front opening being formed in the front end of the tip cartridge; and a rear opening formed in the rear end of the tip cartridge;

a cover being detachably attached to the rear opening of the tip cartridge;

a central post being mounted slidably coaxially through the central chamber and the resilient element to restrict the tip cartridge to longitudinal movement and having a front end protruding from the front opening in the central chamber and being mounting securely in the mounting hole in the mounting rod of the tip socket assembly; and a rear end having two lips being formed on and protruding transversely from the rear end opposite to each other and selectively abutting the inner surface around the non-circular through hole in the body; and a mounting bracket being mounted securely on the front end of the tip cartridge in the rear end of the resilient element and around the central post and having a rear edge;

a central hole corresponding to and aligning with the front opening in the tip cartridge and being mounted around the central post; and a flange being formed on and protruding radially out from the rear edge of the mounting bracket and abutting the rear end of the resilient element; and multiple tips being stored in the clamps of the tip cartridge.

2. The portable screwdriver as claimed in claim 1, wherein the central chamber further has hydraulic fluid inside.

3. The portable screwdriver as claimed in claim 2, the tip cartridge further has a gasket being resilient and being mounted around the central post between the mounting bracket and the front end of the tip cartridge.

4. The portable screwdriver as claimed in claim 1, wherein the button of the body further has a flange being formed on and protruding out from the inner end, keeping the button from being pressed out of the mounting hole and abutting the side surface of the resilient element.

5. The portable screwdriver as claimed in claim 1, wherein the body further has the thumb depression being formed on the outer surface of the body on the top and near the front end; and a nonslip pad being attached to the outer surface of the body adjacent to the thumb depression.

6. The portable screwdriver as claimed in claim 1, wherein the body further has a front cap having a rear end; and a lip formed in and protruding slightly in from the front cap at the rear end of the front cap; and the mounting sleeve further has an annular groove to hold the lip in the front cap.

7. The portable screwdriver as claimed in claim 1, wherein the body further has a rear cap being mounted detachably on the rear end of the body to close the opening.

* * * * *